US005385529A

United States Patent [19]

Koch

[11] Patent Number: 5,385,529

[45] Date of Patent: Jan. 31, 1995

[54] METHOD FOR CONTROLLING THE TEMPERATURE OF AN INCUBATOR

[75] Inventor: Jochim Koch, Ratzeburg, Germany

[73] Assignee: Drägerwerk Aktiengesellschaft, Lübeck, Germany

[21] Appl. No.: 128,869

[22] Filed: Sep. 29, 1993

Related U.S. Application Data

[63] Continuation-in-part of Ser. No. 831,869, Feb. 5, 1992, abandoned.

[30] Foreign Application Priority Data

Feb. 8, 1991 [DE] Germany ..... 4103801

[51] Int. Cl.[6] ..... A61G 11/00

[52] U.S. Cl. ..... 600/22; 128/736

[58] Field of Search ..... 600/21-22; 128/736

[56] References Cited

U.S. PATENT DOCUMENTS 3,920,000 11/1975 Atherton et al. ..... 600/22

FOREIGN PATENT DOCUMENTS 3616359 11/1986 Germany .

2045978 11/1980 United Kingdom ..... 600/22

2236190 3/1991 United Kingdom ..... 600/22

*Primary Examiner*—Lee S. Cohen

*Assistant Examiner*—John Lacyk

*Attorney, Agent, or Firm*—Walter Ottesen

[57] ABSTRACT

A method of controlling the operating parameters of an apparatus for maintaining the temperature of prematures and newborns is improved in that the operating parameters are determined based on a precise definition of the thermal condition of the patient and that information as to the bodily well-being based on determined sensor actual values for controlling the operating parameters are applied. For solving this task, the control takes place basically with the aid of at least two temperature sensors which measure the core temperature and the peripheral temperature, respectively, of the patient. The logic combination of the temperature signals takes place in such a manner that, in addition to the absolute temperature of one of the two sensors, the temperature difference between the two temperature sensors is simultaneously applied. In this way, it is possible for the first time that the thermal well-being of the patient is applied for controlling the incubator parameters and not only a single temperature.

6 Claims, 2 Drawing Sheets

METHOD FOR CONTROLLING THE TEMPERATURE OF AN INCUBATOR

RELATED APPLICATION

This is a continuation-in-part of application Ser. No. 07/831,869, filed Feb. 5, 1992, now abandoned.

FIELD OF THE INVENTION

The invention relates to a method for controlling the operating parameters of an apparatus for maintaining the temperature of prematures and newborns for which sensors are provided to determine the condition actual values. The sensors are connected to the body or disposed in the ambient atmosphere of the body. The initial values of the sensors are supplied to a measured value processing unit and are processed thereby to form actuating variables for influencing the operating parameters of the apparatus.

BACKGROUND OF THE INVENTION

Establishing and maintaining a defined thermal environment is of great significance for newborns and has essentially determined the development of incubators, heated beds, radiation heaters and so-called open intensive care beds and has still not been adequately solved. Generally, the known rectal temperature measurement or a local skin temperature measurement is not sufficient to define the thermal condition and to meter the thermal energy. These measured values as individual values do not provide adequate information with respect to the overall thermal environment of the newborn so that the task is present to provide a method which will provide a complete overview as to the thermal situation of the newborn and its condition with the least possible use of ancillary means. It is of special significance to maintain the so-called condition of well-being for the newborn with the thermal metabolism of the newborn being burdened as little as possible and which is characterized by a minimal consumption of oxygen which is necessary to maintain the life functions.

An incubator equipped with radiation heating elements is disclosed in published German patent application 3,616,359. Here, a sensing or detecting arrangement for the more important parameters is combined with a display device with the parameters including, for example, air temperature, air humidity, skin temperature, pulse frequency and the like. An alarm unit is intended to indicate directly each deviation from the allowed range of the parameters. However, such a monitoring process does not have adequate information as to the temperature zones determining the thermal environment and the control of the operating parameters is therefore essentially determined by pregiven input values.

SUMMARY OF THE INVENTION

In view of the above, it is an object of the invention to provide a method for determining the operating parameters of an apparatus for maintaining the temperature of prematures and newborns directly based on a precisely defined thermal condition of the premature or newborn and to apply information as to the bodily well-being based on detected sensor actual values for controlling the operating parameters of the apparatus.

The method of the invention is for controlling an operating parameter of an apparatus for maintaining the temperature of a patient, the apparatus including heater means responsive to an actuating variable for adjusting the operating parameter in said apparatus. The method includes the steps of: applying first and second temperature sensors to the body of the patient at two locations, respectively, thereon to obtain first and second actual temperature values; supplying the actual temperature values to a measured value processing unit; determining the actual difference $\Delta T_{act}$ value between the actual temperature values; applying first and second desired temperature values and a desired difference $\Delta T_{des}$ value of the desired temperature values to the measured value processing unit with the first and second desired temperature values and the desired difference $\Delta T_{des}$ value being determined specific to the patient by medical personnel attending the patient; logically combining the actual and desired temperature values and the actual difference $\Delta T_{act}$ value and the desired difference $\Delta T_{des}$ value in the measured value processing unit in accordance with a preprogrammed algorithm to obtain a logic signal dependent upon the values; and, applying the logic signal to a controller for generating the actuating variable for controlling the operating parameter via the heater means to maintain the temperature of the patient.

From the foregoing, it is apparent that the method of the invention is more than simply a comparison between actual and desired values; instead, the method provides for a comparison between the actual values of the two sensors and the actual difference $\Delta T_{act}$ value. It is not only the first actual value but also the second actual value which can be utilized as a basis value for the comparison depending upon the particular condition of the patient. Accordingly, the invention provides for adjusting the operating parameter via a logic comparison between an actual temperature value ($T_k$ or $T_p$) and the difference between these two temperatures.

The actual and desired values of the core and peripheral temperatures are inputted to the measured value processing unit and these values and their respective differences are logically combined to obtain a logic signal dependent thereupon. It is this logic signal which is then applied to a controller for generating the actuating variable for controlling the operating parameter of the apparatus (such as an incubator) via the heating means.

The first temperature sensor can be a detector providing an actual value representative of the core temperature of the patient and the second temperature sensor can be a detector providing an actual value representative of the periphery of the patient.

The apparatus can be an incubator defining an interior to which the heater means supplies heat and the method includes the further steps of: interrupting the heat supplied to the interior when the first actual value of temperature exceeds a first upper limit value; and, when the first actual value of temperature drops below a lower limit value and when the difference $\Delta T_{act}$ is present which is equal to or less than difference $\Delta T_{des}$, resuming or continuing the supply of heat to the interior in a controlled manner.

According to another embodiment, wherein the apparatus is an incubator defining an interior to which heat is supplied by the heater means, the method includes the further steps of: interrupting the supply of heat to the apparatus when the actual value of one of the sensors exceeds an upper limit value; and, when the first actual value of temperature drops below a lower limit value and when the second actual value of temperature is within a pregiven temperature range, resuming or continuing the supply of heat.

Another embodiment of the method of the invention is also for controlling an operating parameter of an apparatus for maintaining the temperature of a patient with the apparatus including heater means responsive to an actuating variable for adjusting the operating parameter in said apparatus. In this embodiment, the method includes the steps of: applying first and second temperature sensors to the body of the patient at two locations, respectively, thereon to obtain first and second actual temperature values; supplying the actual temperature values to a measured value processing unit; determining the temperature value of the second temperature sensor and comparing the temperature value to predetermined temperature limits above and below which the temperature of the infant should not move to obtain a comparison signal value; applying the comparison signal value and the temperature value of the first and the second temperature sensors to the measured value processing unit in accordance with a preprogrammed algorithm to obtain a logic signal dependent upon the values; and, applying the logic signal to a controller for generating the actuating variable for controlling the operating parameter via the heater means to maintain the temperature value of the first temperature sensor and/or the second temperature sensor within the predetermined limits.

Still another embodiment of the invention is for controlling an operating parameter of an apparatus for maintaining the temperature of a patient, the apparatus including heater means responsive to an actuating variable for adjusting the operating parameter in said apparatus. In this embodiment, the method includes the steps of: applying first and second temperature sensors to the body of the patient at two locations, respectively, thereon to obtain a first actual temperature value indicative of the core temperature of the patient and a second actual temperature value of a peripheral temperature of the patient; supplying the actual temperature values to a measured value processing unit; determining the actual difference $\Delta T_{act}$ value between the actual temperature values; applying a first desired temperature value corresponding to the desired core temperature of the patient and a second desired temperature value corresponding to the desired peripheral temperature of the patient as well as a desired difference $\Delta T_{des}$ value of the desired temperature values to the measured value processing unit with the first and second desired temperature values and the desired difference $\Delta T_{des}$ value being determined specific to the patient by medical personnel attending the patient; logically combining the actual and desired temperature values and the actual difference $\Delta T_{act}$ value and the desired difference $\Delta T_{des}$ value in the measured value processing unit in accordance with a preprogrammed algorithm and:

(a) determining if the first actual temperature value is greater than the first desired temperature value and, if so, then issuing a fever alarm and interrupting heating via the heating means, and if not, (b) determining if the actual difference $\Delta T_{act}$ value is equal to or greater than the desired difference $\Delta T_{des}$ value and, if so, then interrupting heating via the heating means; and, if not, (c) determining if the actual difference $\Delta T_{act}$ value has increased and the first actual temperature is within its predetermined temperature range and, if so, then issuing a shock alarm and maintaining heating on via the heater means, and if not, also maintaining heating on via the heater means without issuing the shock alarm.

The apparatus to which the method of the invention is applicable includes incubators, heated beds, radiation heaters, open intensive care unit with radiation heat. This list is not complete and can include other possible apparatus of the kind referred to. However, for the convenience of presentation, the following will be directed to an incubator as being representative of the class of apparatus to which the invention is applicable. The method of the invention can be applied to other apparatus insofar as such apparatus is suitable to preparing and maintaining the thermal environment required for the prematures and newborns.

The advantage of the invention is seen in that a single body temperature will no longer be governing for the operating parameters of the incubator; instead, at least two body temperatures will be applied which are measured at different locations. For example, the first temperature sensor can measure the core temperature and the second temperature sensor the peripheral temperature of the body. A statement as to the condition of the patient disposed in the incubator can now be made with the knowledge of the central core temperature and of the peripheral temperature in addition to the actual measured temperature. For example, attending personnel can distinguish as to whether the body is hypothermal, normothermal or hyperthermal. This information will not permit the measurement made to date which is directed only to a single temperature such as the skin temperature. For this reason, the use of a skin temperature control unit for an incubator is limited.

In shock condition (normal core temperature, cold skin temperature), the skin temperature control by itself would heat the patient in the incubator to a fever temperature. In the fever condition (high core temperature, high or cold skin temperature depending on the time point of measurement), the skin temperature control would either cool down the fever or increase it without the attending personnel being able to make a determinative diagnosis.

With the measurement of at least two temperature values, an inference can be drawn as to the well-being condition of the patient and the correct decision can be made by the attending personnel. The control is so utilized that the patient is maintained at the core temperature while considering its general thermal condition. Accordingly, the method of the invention is not concerned with only a fixed control to a specific control variable (preferably the temperature) measured at a single location; instead, the method is directed to the adapted control while considering various conditions of the patient with respect to its thermal metabolism.

Advantageously, the first temperature sensor measures an actual value representative of the core temperature and the second temperature sensor measures an actual value representative of the periphery. With the data they provide, these two measuring locations cover most conditions of the patient in the incubator which can occur with reference to the thermal metabolism of the patient.

A further advantageous embodiment of the method is that the supply of heat into the incubator interior is interrupted when the temperature actual value of the first sensor exceeds a first upper limit value; and, that the supply of heat is again restored or is maintained in a controlled manner when there is a drop below a lower limit value accompanied by the presence of an actual-value difference between the two sensors. With this type of logic connection of the temperature actual values, it is ensured that the upper limit value defines a safety value above which the patient cannot be warmed under any circumstances. If, in contrast, the temperature actual value of the first sensor drops below a lower limit value and if there is nonetheless a difference present between the actual values of the first and second sensors, then the supply of heat in a normal controlled manner is either maintained or is again restored. When the temperature (for example, the core temperature) of the first sensor exceeds an upper limit value, the heat is then switched off since the assumption can then be made that a fever condition is present. The heater is again switched on or continues to operate normally within the preset control characteristic when there is a drop below the lower limit value for the core temperature and there is a temperature difference present between the two sensors (hypothermia).

It can likewise be advantageous that, when the temperature actual value of one of the two sensors exceeds an upper limit value, the supply of heat is interrupted; and, that, when there is a drop below the temperature actual value of the first sensor below a lower limit value and when there is a temperature actual value of a second sensor within a pregiven temperature range, the supply of heat is restored or maintained. For example, if the upper limit value is 37.5° C. for the sensor for measuring the body core temperature, then the heater will be switched off when this temperature is exceeded. If there is drop of the actual value of this sensor below 36° C. and for a temperature actual value of the second sensor within for example 37° to 37.5° C., the heater is switched on or remains switched on. The measured value processing unit processes therefore the logic comparison values in such a manner that the patient in the incubator is maintained as to the desired core temperature as well as to the peripheral temperature. This condition can be defined as "thermal comfort" which is characterized by a minimal consumption of oxygen whereby the circulation and the activity of the organs of the patient are not overstressed.

The advantages of the method of the invention and its advantageous configurations are described with reference to the following examples.

EXAMPLE 1

The core temperature is measured with one sensor and the peripheral temperature is measured with the other sensor for example at the foot. The core temperature is approximately 37° C. and the temperature of the foot is approximately 2° C. colder.

1° C. is set as a temperature difference desired value. Accordingly, the incubator air heater is switched on in order to warm the newborn more. The heater is switched off when the difference between the core and the peripheral temperatures reaches the desired value of 1° C.

The desired value input for the temperature difference is decided by attending personnel in dependence upon the age, the weight at birth and the gestational age and is inputted to the measured value processing unit via a key pad.

In the method of the invention, it is not the absolute temperature value which is of interest. Instead, the temperature difference of two sensors is of importance. If the core temperature is the higher of the two temperatures then it is apparent that too much heat is imparted to the patient so that the heater is switched off. If $\Delta T_{act} > \Delta T_{des}$, then an alarm is issued. For this reason, it is not the absolute value of the temperature which is important but the difference. If this difference is within the pregiven limit values, then the control condition for the heater remains constant as noted above.

A governing limit is defined by the safety values (for example: peripheral temperature > 36° C., core temperature > 38.0° C.). The heater is switched off in every instance where the safety values are exceeded. The same situation applies for hypothermic limit values.

When the actual value of core temperature is equal to the desired value thereof, heating in the incubator is in equilibrium and the status is maintained as long as no deviation occurs between actual and desired values.

EXAMPLE 2

When the core temperature is greater than 37.5° C., the heater of the incubator is not switched on even though a desired value for the temperature difference of 3° C. has been put in and the foot is 4° C. colder than the core. The newborn could just then be in a fever condition wherein the blood flow is centralized. This condition can be detected by the simultaneous measurement of the absolute core temperature and the temperature difference measurement and an appropriate warning can be given.

This situation is not covered by the known temperature control devices. The incubator heat output would then still be increased and the fever condition exacerbated without a warning being given when only the peripheral temperature actual value would be applied for control.

EXAMPLE 3

The patient has just slipped into a shock-like condition. The core temperature is normal and the temperature of the periphery drops suddenly and greatly. The measured value processing unit would analyze this situation as a shock condition and assistance can be called by an appropriate warning. The heating of the incubator can continue normally so that the newborn neither becomes hypothermic (too cold) nor becomes hyperthermic (too hot).

This condition would likewise not be detected by the known temperature control arrangements. These would have caused the heat output of the incubator to be greatly increased and possibly made the newborn hyperthermal without a warning being given.

There must always be a simultaneous drop of the core temperature together with the presence of a temperature difference $\Delta T$ (that is, a logic "and"). For example, if the lower temperature limit is 37.1° C. and the temperature difference is zero (that is, $T_k = T_p$), then the 37.1° C. is still in the desired temperature range. However, if $\Delta T(T_k < T_p)$ is greater than permitted by the logic comparison value (Example 1), then we have the situation of a patient in hypothermia and the heater must be switched on the difference $\Delta T$ is within the desired limits, then the heater control can remain unchanged; that is, no additional heat is needed.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
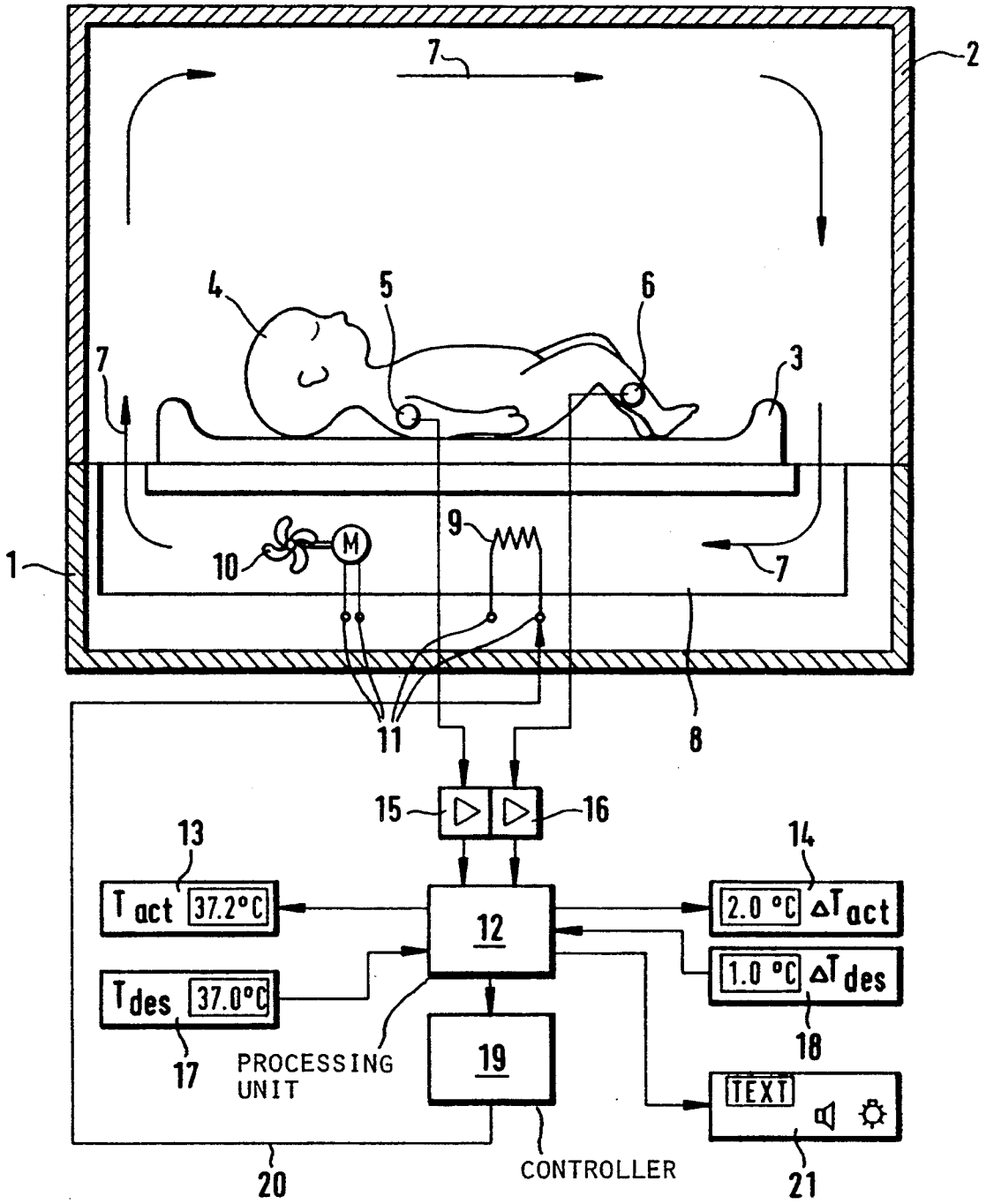
FIG. 1 is a block diagram of an incubator equipped with a measured value processing unit; and, FIG. 2 is a logic sequence diagram for the control of the operating parameters.

In FIG. 1, an incubator housing 1 is shown on which an incubator hood 2 is seated. A cot 3 is disposed within the interior of the incubator and a patient 4 is shown resting thereon. A first temperature sensor 5 for measuring the core temperature $T_K$ and a second temperature sensor 6 is mounted on the foot for measuring the peripheral temperature $T_p$. Warming the interior of the incubator is achieved by circulating the interior air in the direction by flow arrows 7. The incubator air is passed through a flow channel 8 in which a heating device 9 as well as a blower 10 are mounted. In this way, the flow of the heated incubator air is maintained. The heating device 9 and the blower 10 are connected via connecting terminal 11 to current supply units (not shown). The temperature sensors (5, 6) and the measurement amplifiers (15, 16) are connected to a measured value processing unit 12. The actual values detected by the sensors (5, 6) are shown on the actual-value display 13. The two values transmitted from the measurement amplifiers (15, 16) are compared by the measured value processing unit 12 and the resulting difference value is shown on the difference value display 14. The desired values corresponding to the temperature values and the difference values are inputted to the desired-value display 17 and the difference desired-value display 18, respectively, and are displayed there. The corresponding desired values (17, 18) are supplied to the measured value processing unit 12. Actual values and desired values are logically combined in accordance with a preprogrammed algorithm in a process computer contained in the processing unit 12. The corresponding logic results are transmitted as a logic signal to a controller 19 connected downstream of the processing unit 12. The controller 19 is connected via a control line 20 to one of the connecting contacts 11 of the heater device 9. A warning and display unit 21 displays the thermal condition of the patient in accordance with the logic results determined from the measured value processing unit. The thermal condition of the patient is based on the measured temperature values and the warning and display unit 21 displays this thermal condition and transmits optically and/or acoustically undesired conditions.

Figure 2:
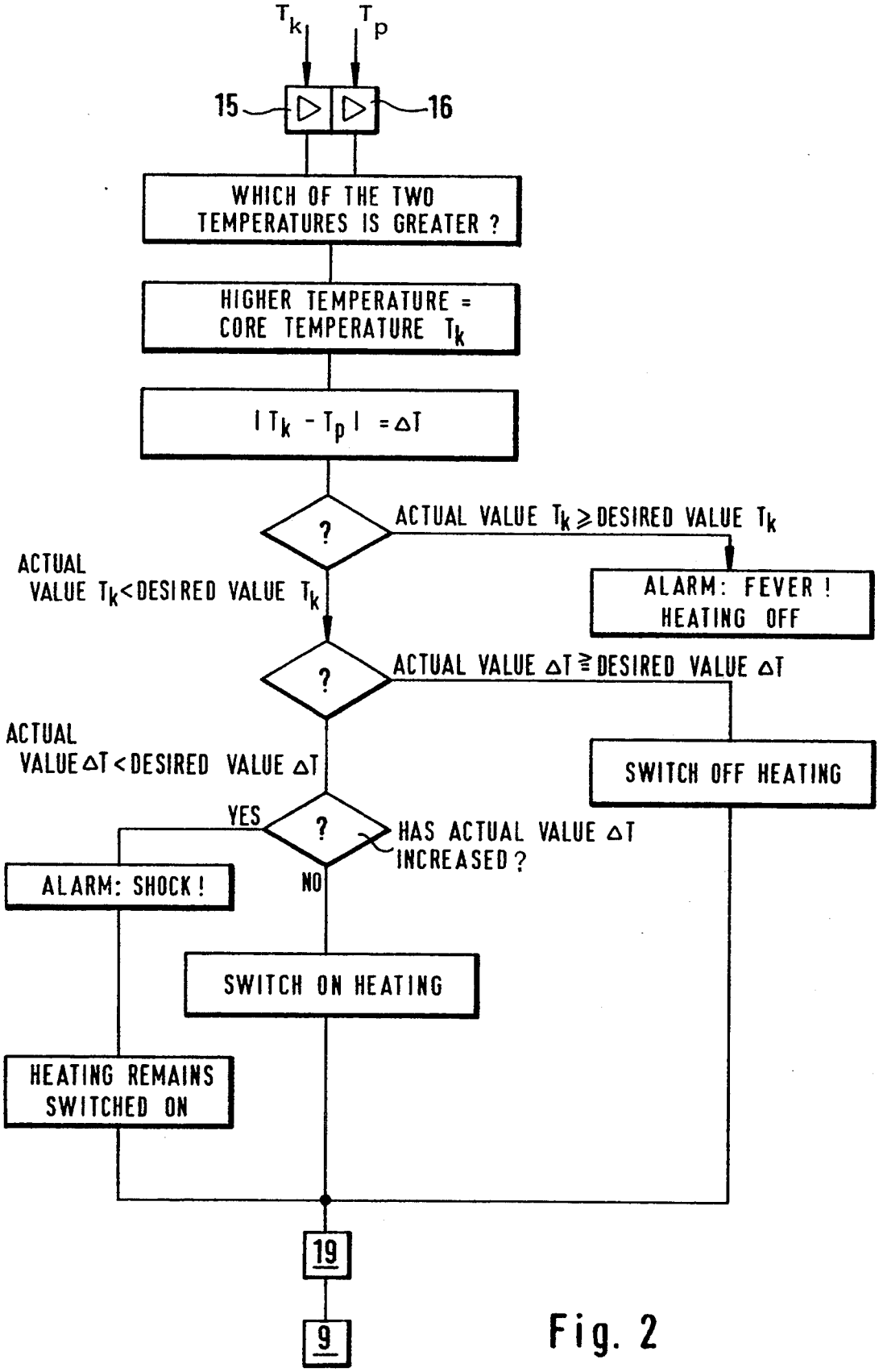

FIG. 2 shows the logic sequence as it is processed in the algorithm of the measured value processing unit 12. The signals from the measurement amplifiers (15, 16) are first checked as to which of the temperatures ($T_K$ and $T_p$) detected by the sensors (5, 6) is the larger. Thereafter, the determination is, for example, made that the higher of the temperatures is the core temperature $T_K$. After a subsequent difference value formation $\Delta T_{act}$, an inquiry is made as to whether the actual value $T_K$ is equal to or greater than the desired value $T_K$ (upper limit value). If this is the case, then the heater is switched off and an acoustic warning is supplied as well as displaying the word "fever" on the warning and display unit 21. If the actual value $T_K$ is less than the desired value $T_K$ (below the upper limit value), a further inquiry is made as to whether the actual value of the temperature difference $\Delta T_{act}$ is equal to or greater then the desired value for the temperature difference $\Delta T_{des}$. If this is the case, then the heater is switched off; however, if the actual value $\Delta T$ is less than the desired value $\Delta T$, then an inquiry is made as to how great the rate of increase of the actual value $\Delta T$ is. If the rate of increase of the actual value $\Delta T$ is high, the algorithm of the measured value processing unit 12 detects a shock condition which is displayed on the warning and indicating device 21 acoustically and by a text indication "shock". The heater 9 then remains switched on and the incubator temperature is set to normal control values. If the deviation of the actual value $\Delta T$ takes place only slowly in the course of time from the desired value $\Delta T$, an unwanted cooling of the periphery has occurred so that the heater is switched on to provide the needed energy.

The limitations as to "high" and "low" are in accordance with physiological values based on the experience of the attending medical personnel. These values are inputted to the measured value processing unit 12 and must not be exceeded.

With respect to the foregoing, it will now be shown what happens when the actual difference value is greater than the desired difference value.

In the Examples 2 and 3 discussed above, the peripheral temperature has fallen off greatly so that the difference between the actual core temperature $T_k$ and peripheral temperature $T_p$ is greater than permitted The temperature control however remains normal because the core temperature $T_k$ is normal and the temperature control is not set to provide a higher temperature of the incubator air. The above-mentioned safety limit values, however, remain as the final control criteria; that is, the core temperature must not become greater than 37.5° C. even for a shock condition. The logic operations and status displays are stored in the measured-value processing unit 12 shown in FIG. 1 and can be inputted in accordance with the status of the particular patient (weight, gestational age and the like) by attending medical personnel.

It is understood that the foregoing description is that of the preferred embodiments of the invention and that various changes and modifications may be made thereto without departing from the spirit and scope of the invention as defined in the appended claims.

What is claimed is:

1. A method for controlling an operating parameter of an apparatus for maintaining the temperature of a patient, the apparatus including heater means responsive to an actuating variable for adjusting the operating parameter in said apparatus, the method comprising the steps of:

applying a first temperature sensor to the body of the patient at a first location thereon to provide a first actual value representative of the core temperature of the patient;

applying a second temperature sensor to the body of the patient at a second location thereon remote from said first location to provide a second actual value representative of the periphery of the patient;

supplying said actual temperature values to a measured value processing unit;

determining the actual difference $\Delta T_{act}$ value between said actual temperature values;

applying first and second desired temperature values and a desired difference $\Delta T_{des}$ value of said desired temperature values to said measured value processing unit with said first and second desired temperature values and said desired difference $\Delta T_{des}$ value being determined specific to the patient by medical personnel attending the patient;

logically combining said actual temperature values and said desired temperature values and said actual difference $\Delta T_{act}$ value and said desired difference $\Delta T_{des}$ value in said measured value processing unit in accordance with a preprogrammed algorithm to obtain a logic signal dependent upon said values; and, applying said logic signal to a controller for generating said actuating variable for controlling said operating parameter via said heater means for maintaining the temperature of the patient.

2. The method of claim 1, wherein the apparatus is an incubator defining an interior to which said heater means supplies heat; and, wherein the method comprises the further steps of:

interrupting the heat supplied to said interior when said first actual value of temperature exceeds a first upper limit value; and, when said first actual value of temperature drops below a lower limit value and when said difference $\Delta T_{act}$ is present which is equal to or less than said difference $\Delta T_{des}$, resuming or continuing the supply of heat to said interior in a controlled manner.

3. The method of claim 1, wherein the apparatus is an incubator defining an interior to which heat is supplied by said heater means; and, wherein the method comprises the further steps of:

interrupting the supply of heat to said apparatus when the actual value of one of said sensors exceeds an upper limit value; and, when said first actual value of temperature drops below a lower limit value and when said second actual value of temperature is within a pregiven temperature range, resuming or continuing said supply of heat.

4. A method for controlling an operating parameter of an apparatus for maintaining the temperature of a patient, the apparatus including heater means responsive to an actuating variable for adjusting the operating parameter in said apparatus, the method comprising the steps of:

applying a first temperature sensor to the body of the patient at a first location thereon to provide a first actual value representative of the core temperature of the patient;

applying a second temperature sensor to the body of the patient at a second location thereon remote from said first location to provide a second actual value representative of the periphery of the patient;

supplying said actual temperature values to a measured value processing unit;

determining the temperature value of said second temperature sensor and comparing said temperature value to predetermined temperature limits above and below which the temperature of the patient should not move to obtain a comparison signal value;

applying said comparison signal value and said temperature value of said first and said second temperature sensors to said measured value processing unit in accordance with a preprogrammed algorithm to obtain a logic signal dependent upon said values; and, applying said logic signal to a controller for generating said actuating variable for controlling said operating parameter via said heater means to maintain said temperature value of said first temperature sensor and/or said second temperature sensor within said predetermined limits.

5. The method of claim 4, wherein the apparatus is an incubator defining an interior to which heat is supplied by said heater means; and, wherein the method comprises the further steps of:

interrupting the supply of heat to said apparatus when the actual value of one of said sensors exceeds an upper limit value; and, when said first actual value of temperature drops below a lower limit value and when said second actual value of temperature is within a pregiven temperature range, resuming or continuing said supply of heat.

6. A method for controlling an operating parameter of an apparatus for maintaining the temperature of a patient, the apparatus including heater means responsive to an actuating variable for adjusting the operating parameter in said apparatus, the method comprising the steps of:

applying first and second temperature sensors to the body of the patient at two locations, respectively, thereon to obtain a first actual temperature value indicative of the core temperature of the patient and a second actual temperature value of a peripheral temperature of the patient;

supplying said actual temperature values to a measured value processing unit;

determining the actual difference $\Delta T_{act}$ value between said actual temperature values;

applying a first desired temperature value corresponding to the desired core temperature of the patient and a second desired temperature value corresponding to the desired peripheral temperature of the patient as well as a desired difference $\Delta T_{des}$ value of said desired temperature values to said measured value processing unit with said first and second desired temperature values and said desired difference $\Delta T_{des}$ value being determined specific to the patient by medical personnel attending the patient;

logically combining said actual and desired temperature values and said actual difference $\Delta T_{act}$ value and said desired difference $\Delta T_{des}$ value in said measured value processing unit in accordance with a preprogrammed algorithm and:

(a) determining if said first actual temperature value is greater than said first desired temperature value and, if so, then issuing a fever alarm and interrupting heating via said heating means, and if not, (b) determining if said actual difference $\Delta T_{act}$ value is equal to or greater than said desired difference $\Delta T_{des}$ value and, if so, then interrupting heating via said heating means; and, if not, (c) determining if said actual difference $\Delta T_{act}$ value has increased and said first actual temperature is within its predetermined temperature range and, if so, then issuing a shock alarm and maintaining heating on via said heater means, and if not, also maintaining heating on via said heater means without issuing said shock alarm.

* * * * *

UNITED STATES PATENT AND TRADEMARK OFFICE

CERTIFICATE OF CORRECTION

PATENT NO. : 5,385,529

DATED : January 31, 1995

INVENTOR(S) : Jochim Koch

It is certified that error appears in the above-identified patent and that said Letters Patent is hereby corrected as shown below:

In column 6, line 62: between "on" and "the" insert -- . If --.

In column 8, line 26: between "permitted" and "The", please insert -- . --.

Signed and Sealed this

Twenty-first Day of March, 1995

*Attest:*

*Attesting Officer*

BRUCE LEHMAN

*Commissioner of Patents and Trademarks*